US005452065A

United States Patent [19]

Bell

[11] Patent Number: 5,452,065

[45] Date of Patent: Sep. 19, 1995

[54] COMBINATION PHOTORECEPTOR AND FUSER ROLL CLEANER WITH ADDITIONAL OIL SUPPLY FUNCTION

[75] Inventor: Conrad J. Bell, Webster, N.Y.

[73] Assignee: Xerox Corporation, Stamford, Conn.

[21] Appl. No.: 317,436

[22] Filed: Oct. 4, 1994

[51] Int. Cl.[6] ..... G03G 15/20; G03G 15/22

[52] U.S. Cl. ..... 355/283; 355/284; 355/296; 355/300

[58] Field of Search ..... 355/282, 283, 284, 215, 355/296, 297, 298, 300, 285, 290, 77

[56] References Cited

U.S. PATENT DOCUMENTS

| | | | |
|---|---|---|---|
| 3,615,397 | 10/1971 | Dimond et al. | 96/1.4 |
| 4,393,804 | 7/1983 | Nygard et al. | 118/60 |
| 4,475,156 | 10/1984 | Federico et al. | 364/300 |
| 4,557,588 | 12/1985 | Tomosada | 355/300 |
| 4,924,271 | 5/1990 | Brinton et al. | 355/284 |
| 5,049,944 | 9/1991 | Debolt et al. | 355/284 |
| 5,069,128 | 12/1991 | Hara et al. | 355/300 X |
| 5,243,393 | 9/1993 | Menjo | 355/284 |
| 5,356,473 | 10/1994 | Fromm | 118/60 |

FOREIGN PATENT DOCUMENTS

| | | | |
|---|---|---|---|
| 58-34476 | 2/1983 | Japan | 355/300 |
| 61-121076 | 6/1986 | Japan | 355/300 |

*Primary Examiner*—Sandra L. Brase

[57] ABSTRACT

The invention is directed towards a web cleaning system which is used in a xerographic reproduction machine to simultaneously clean the surface of a photoreceptor and of a fuser roll. The fuser roll is of the type having an elastomer coating requiring application of a silicone oil. The web cleaning system performs a third function by applying a predetermined amount of oil from an oil donor web onto the side of the web which cleans the fuser roll surface. In a further aspect of the invention, the web cleaning components are mounted in a customer replaceable unit (CRU) for convenient removal.

4 Claims, 1 Drawing Sheet

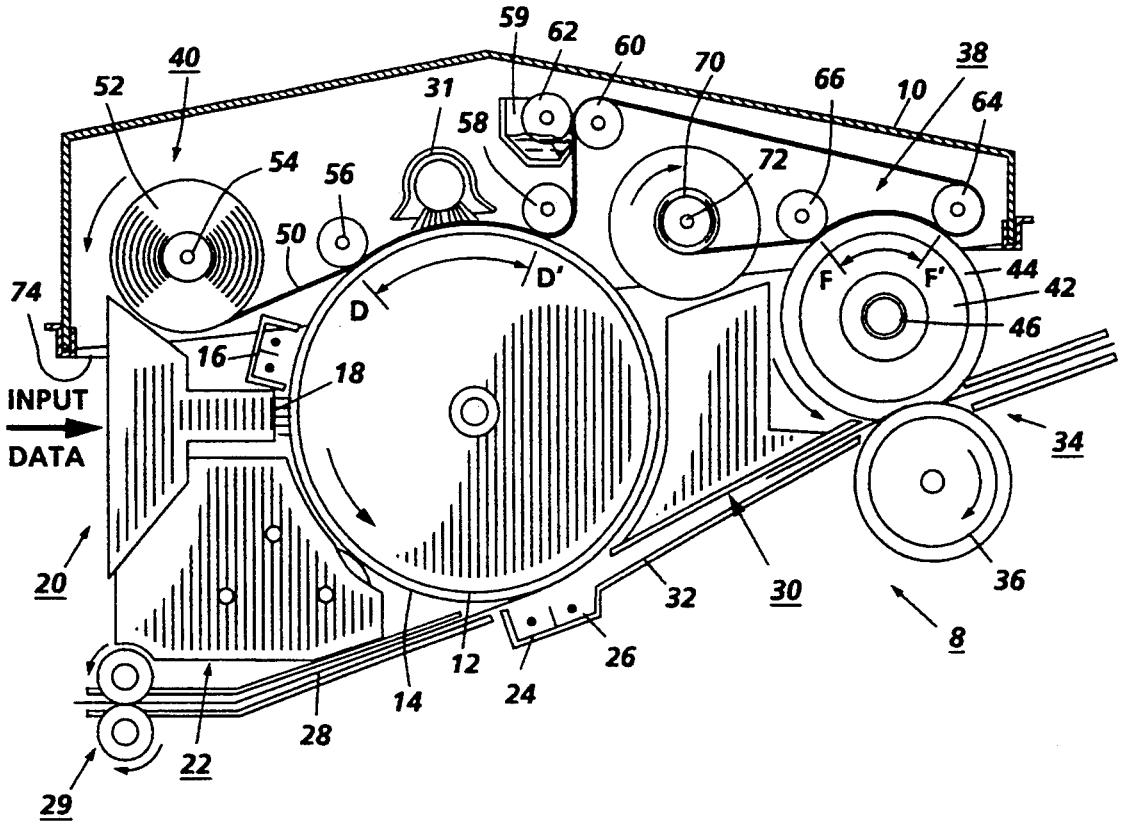
59
62
60
70
66
38
10
64
40
52
31
58
54
56
72
50
D'
D
F
F'
44
42
46
74
16
18
INPUT
DATA
34
20
36
32
30
8
12
26
14
24
28
22
29

COMBINATION PHOTORECEPTOR AND FUSER ROLL CLEANER WITH ADDITIONAL OIL SUPPLY FUNCTION

BACKGROUND AND MATERIAL DISCLOSURE STATEMENT

The invention relates generally to a xerographic copier/xerographic reproduction machine and more particularly to a means and method for simultaneously cleaning the surface of a photoreceptor and a heated fuser roll while supplying oil to the fuser roll surface.

In the process of xerographic copying and printing, a latent image of a document being copied is formed on the surface of a photoreceptor member such as a drum or belt. The latent image is developed and transferred to a copy sheet. The transferred image is fixed in a fusing station. In one prior art fusing system, a fuser roll is used which has an outer surface or covering of polytetrafluoroethylene or silicone rubber, the former being known by the trade name Teflon TM, to which a release agent such as silicone oil is applied, the thickness of the Teflon being on the order of several mils and the thickness of the oil being less than 1 micron. Silicone-based oils which possesses a relatively low surface energy have been found to be materials that are suitable for use in a heated fuser roll environment where Teflon constitutes the outer surface of the fuser roll. In practice, a thin layer of silicone oil is applied to the surface of the heated roll to form an interface between the roll surface and the toner images carried onto the support material. Thus a low surface energy layer is presented to the toner as it passes through he fuser nip and thereby prevents toner from offsetting to the fuser roll surface.

U.S. Pat. No. 4,924,271 whose contents are hereby incorporated by reference discloses one arrangement for oil distribution to a heated fuser roll.

With the prior art system of the type described above, several cleaning functions are required. The surface of the photoreceptor drum or belt must be cleaned of residual toner. The fuser roll surface also accumulates residual toner which must be cleaned from the surface. U.S. Pat. No. 3,615,397 discloses a method for simultaneously cleaning the surface of a drum photoreceptor and of a pressure roll fuser. The present invention improves upon this arrangement by enabling a third function using the web that cleans the photoreceptor fuser roll surface to also supply oil to the surface of the heated fuser roll. Further the invention contemplates housing the cleaning and oil distribution system in a modular CRU (Customer Replaceable Unit)design. More particularly, the present invention relates to an apparatus for forming toner images on a photoreceptor, the apparatus including:

a heated fuser roll with an elastomer-coated surface, a release and distribution system for dispensing oil onto said fuser roll coated surface, a cleaning system for simultaneously cleaning the surface of said photoreceptor and said fuser roll surface while supplying oil to said fuser roll surface, said cleaning station comprising:

a cleaning web mounted on a supply roll, means for advancing the cleaning web so as to contact and provide wiping action along one arc segment of the photoreceptor thereby cleaning the surface of the photoreceptor, means for advancing the cleaning web into an oil deposition station wherein a previously determined amount of oil is transferred to the clean side of the web and means for further advancing the web so as to bring the clean and oiled side of the web in contact with an arc segment of the fuser oil elastomer surface thereby simultaneously cleaning and oiling the surface and third means for advancing the web into a take-up roll.

BRIEF DESCRIPTION OF THE DRAWING

The FIGURE is a schematic side view of a reproduction machine which incorporates the web cleaning and oil distribution system of the present invention.

DESCRIPTION OF THE INVENTION

Referring to the FIGURE, there is shown a xerographic type reproduction machine 8 incorporating the combined photoreceptor and fuser roll cleaner and oil distribution web of the present invention. Machine 8 has a suitable frame 10 on which the machine xerographic components are operatively supported. Briefly, and as will be familiar to those skilled in the art, the machine xerographic components include a recording member, shown herein the form of a rotatable photoreceptor 12. In the exemplary arrangement shown, photoreceptor 12 comprises a drum having a photoconductive surface 14. Operatively disposed about the periphery of photoreceptor 12 are a charge corotron 16 for placing a uniform charge on the photoconductive surface 14; an exposure station 18 where the previously charged photoconductive surface 14 is exposed by an imager 20 which can be, for example, an LED print bar. The image data input to imager 20 results in formation of a latent image of a document on surface 14. Proceeding with the description, development station 22 causes development of the electrostatic image by deposition of toner of appropriate polarity. Transfer detack corotrons 24 and 26 assist transfer of the developed image to a suitable copy sheet such as a paper sheet 28 brought forward in timed relation with the the developed image on photoconductive surface 14. A portion of the residual toner is removed from the drum surface at cleaning station 30; however, some toner still remains on the drum surface. Sheets 28 are brought forward to the transfer area by a feed roller pair 29 along sheet guide 32 serving to guide the sheet along a generally upwardly extending path. Following transfer, the sheet 28 is carried forward to a fusing station 34 where the sheet bearing the transferred toner image is introduced into the nip formed between a compression roll 36 and an internally heated fuser roll 38. Fuser roll 38 has a stainless steel core 42 upon which is spray coated layer 44, an elastomer material which in a preferred embodiment is silicone rubber with a thickness of 0.005 inch. The roll is heated by an internal heating element 46. Silicone oil is periodically supplied to the surface of roll 38 by a cleaning and oiling web system 40 described in greater detail below. After fusing, sheet 28 is discharged to an output tray (not shown).

A suitable controller, also not shown, is provided for operating the various components of machine 8 in predetermined relation with one another to produce copies.

Turning now to consideration of the combination cleaning and oiling web system 40, a web 50 is unwound from supply roll 52 which is rotatably supported on a shaft 54. Web 50, in a preferred embodiment, is comprised of a fibrous material having liquid absorbent properties. It will be appreciated that, during operation of machine 8, the photoreceptor 12 will have successive images formed on its surface which are subsequently developed and transferred. Cleaning station 30 may not be completely effective in removing excess toner or dirt particles from surface 14 of the drum. As one aspect of the invention, web 50 is biased by rollers 56, 58 so as to contact and clean, in a wiping action, surface 14 of drum 12 along an arc segment D–D. The web 50 is entrained about directional rollers 58, 60 along a vertically upward vertical path bringing it into a nip formed by roller 60 and supply oil donor roll 62. Donor roll 62 is in contact with the reservoir 59 of oil, the oil in this embodiment, being a low viscosity centisoke silicone oil. Roller 62 is biased by means not shown but with a force sufficient to transfer some optimum, predetermined amount of oil to web 50 as it passes through the roll 60, 62 nip. Web 50 is wound around roller 60, 64 and 66 so as to engage a portion of arc segment F–F of the surface 44 of fuser roll 38. Web 50 is wound up by take-up roll 70 rotatably mounted on shaft 72.

In operation, machine 8 is activated by a print start switch or the like. An image is formed on the charged surface of drum 12 by imager 20 in response to input image data signals. The latent image is developed at developing station 22 and transferred to a sheet 28 by transfer corotrons 24, 26. The sheet advances along the paper path to fusing station 34 where the image is fused while passing through the fuser roll 38, pressure roll 36 nip. Simultaneously, and under control of a system controller of the type disclosed in U.S. Pat. No. 4,475,156 whose contents are hereby incorporated by reference, web 50 is unwound from supply roll 52 and wound up on take-up roll 72. As it moves along the web path, web 50 is simultaneously cleaning the surface D–D of drum 12, accepting silicone oil from donor roll 62 on its opposite (clean) side and cleaning the surface of fuser roll 38 while applying release oil along fuser roll F, F′.

According to another aspect of the present invention, the components of the cleaning system 40 are of modular construction and are housed in a consumer replaceable unit CRU 70; thus, the supply and take-up roll 52, 70 and the web 50 as well as the donor roll and oil reservoir can be conveniently withdrawn from the frame 10 of the machine by sliding outward (away from the page) for repair or replacement.

While the invention has been described with reference to the structure disclosed, it will be appreciated that numerous changes and modifications are likely to occur to those skilled in the art, and it is intended to cover all changes and modifications which fall within the true spirit and scope of the invention. As an example, if web 50 is made of a transparent or partially transparent material, a lamp 31 (FIG. 1) can be positioned so as to illuminate the drum surface through the web to discharge the drum which helps to further loosen toner particles adhering thereto and thereby to discharge the drums residual charges.

What is claimed:

1. In an apparatus for forming toner images on a photoreceptor, the apparatus including:

a heated fuser roll with an elastomer-coated surface, a release and distribution system for dispensing oil onto said fuser roll coated surface, a cleaning system for simultaneously cleaning the surface of said photoreceptor and said fuser roll surface while supplying oil to said fuser roll surface, said cleaning system comprising:

a cleaning web mounted on a supply roll, means for advancing the cleaning web so as to contact and provide wiping action along one arc segment of the photoreceptor thereby cleaning the surface of the photoreceptor, means for advancing the cleaning web into an oil deposition station wherein a previously determined amount of oil is transferred to the clean side of the web and means for further advancing the web so as to bring the clean and oiled side of the web in contact with an arc segment of the fuser roll elastomer surface thereby simultaneously cleaning and oiling the surface and third means for advancing the web into a take-up roll.

2. The apparatus of claim 1 wherein said supply roll, third advancing means, said oil deposition station and take-up roll are mounted in a customer replaceable unit (CRU).

3. The apparatus of claim 1 wherein said cleaning web is at least partially light-transmissive and further including an illumination source positioned adjacent to said photoreceptor arc segment so as to irradiate said segment through said web.

4. A method for simultaneously cleaning the surface of a photoreceptor and a fuser roll used in a xerographic reproduction machine while also simultaneously applying oil to the surface of the fuser roll including the steps of:

advancing a clean web so as to present one side of the web to a portion of the photoconductor, moving the web along said photoreceptor to provide a cleaning action thereon, simultaneously passing a clean side of said web into contact with an oil supply reservoir transferring to the clean side of the web a predetermined amount of oil and advancing the oiled clean side of the web into contact with the surface of the fuser roll so as to clean said fuser roll while simultaneously supplying oil to the fuser roll surface.

* * * * *